United States Patent [19]

Anderson

[11] 4,366,919

[45] Jan. 4, 1983

[54] COMPOSITE CARTRIDGE AND DEVICE FOR METERING EXTRUSION OF CONTENTS

[75] Inventor: Steven R. Anderson, Edina, Minn.

[73] Assignee: Coaxial Cartridges, Inc., Edina, Minn.

[21] Appl. No.: 31,789

[22] Filed: Apr. 20, 1979

Related U.S. Application Data

[63] Continuation-in-part of Ser. No. 901,857, May 1, 1978, abandoned.

[51] Int. Cl.[3] ..... B67D 5/52

[52] U.S. Cl. ..... 222/137; 222/327; 222/386.5; 222/568

[58] Field of Search ..... 222/94, 137, 142.5, 222/326–327, 390–391, 386.5, 567–568, 564, 575; 366/336, 338–339; 128/218 M, 220, 237; 425/87, 133.1; 220/446–447

[56] References Cited

U.S. PATENT DOCUMENTS

| | | | |
|---|---|---|---|
| 2,111,582 | 3/1938 | Crewe . | |
| 2,750,900 | 6/1956 | Moore . | |
| 2,788,159 | 4/1957 | Crewe . | |
| 2,826,339 | 3/1958 | Maillard | 222/137 |
| 2,838,210 | 6/1958 | Detrie et al. . | |
| 2,941,699 | 6/1960 | Schmidt et al. | 222/386.5 X |
| 2,973,883 | 3/1961 | Modderno . | |
| 3,028,052 | 4/1962 | Archer . | |
| 3,076,225 | 2/1963 | Sherbondy . | |
| 3,135,428 | 6/1964 | Gallo, Sr. . | |
| 3,144,966 | 8/1964 | Cook . | |
| 3,182,860 | 5/1965 | Gallo, Sr. . | |
| 3,188,056 | 6/1965 | Trumbull et al. . | |
| 3,215,320 | 11/1965 | Heisler et al. . | |
| 3,227,319 | 1/1966 | Rosier | 222/94 |
| 3,272,389 | 9/1966 | Frangos . | |
| 3,286,992 | 11/1966 | Armeniades et al. . | |
| 3,323,682 | 6/1967 | Creighton, Jr. et al. . | |
| 3,330,444 | 7/1967 | Raypholtz | 222/137 |
| 3,370,754 | 2/1968 | Cook et al. . | |
| 3,390,814 | 7/1968 | Creighton et al. | 222/137 |
| 3,494,359 | 2/1970 | Zackheim . | |
| 3,543,967 | 12/1970 | O'Connor . | |
| 3,620,417 | 11/1971 | Simms . | |
| 3,658,213 | 4/1972 | Plumer . | |
| 3,739,947 | 6/1973 | Baumann et al. . | |
| 3,815,791 | 6/1974 | Clark . | |
| 3,827,602 | 8/1974 | Nicholls | 222/137 |

FOREIGN PATENT DOCUMENTS

| | | | |
|---|---|---|---|
| 10913 | 9/1956 | Fed. Rep. of Germany | 222/137 |
| 545812 | 1/1922 | France . | |
| 747286 | 3/1956 | United Kingdom . | |
| 793277 | 4/1958 | United Kingdom . | |
| 1132408 | 10/1968 | United Kingdom . | |

*Primary Examiner*—Charles A. Marmor

*Attorney, Agent, or Firm*—Wenderoth, Lind & Ponack

[57] ABSTRACT

A composite cartridge contains in separated condition therein, two different fluid compositions which cure on mixing, plus structural components for making such a cartridge. The cartridge has an elongated cylindrical main body with a protruding round neck at its head end and with plunger-movable closure means at its butt end. One composition is enclosed in an inner central chamber having a disc-like closure. The other is in an outer ring chamber oriented coaxially about the central chamber and having a donut-like closure. Each chamber is connected to a separate passageway through the neck of the cartridge, and each passageway has a voidable seal. A structure solely at the head end braces the central chamber against relative movement within the cartridge during plunger extrusion of the compositions. A fastening device on the cartridge neck is for locking a mixing nozzle thereon.

Apparatus, separately and in combination with the cartridge, is for simultaneous metering extrusion of the separated compositions from the cartridge. The apparatus comprises a frame, and a plunger assembly of coaxial elements mounted in and guided by the frame for linear advancement as a unit with respect thereto. The frame is equipped with a holding means for retaining the cartridge with its butt end closures axially aligned anteriorly to the coaxial elements of the plunger assembly. An advancing means provides for advancement of the plunger assembly with respect to the frame.

10 Claims, 14 Drawing Figures

COMPOSITE CARTRIDGE AND DEVICE FOR METERING EXTRUSION OF CONTENTS

CROSS-REFERENCE TO RELATED APPLICATION

This application is a continuation-in-part of my application Ser. No. 901,857, filed May 1, 1978, now abandoned.

BACKGROUND OF THE INVENTION

This invention relates to a storable and shippable composite cartridge containing, in separated condition therein, at least two different fluid compositions which cure on being mixed together. The invention also relates to structural components for making such a cartridge. It further relates to the combination of such a cartridge with apparatus for metering extrusion of its contents, and to the apparatus as a separate entity.

Many two part curable systems are now widely used in a variety of applications, especially as adhesives, bonding agents, potting agents, structural fillers, coatings, seals, liners, and the like. Such systems generally consist of a fluid composition which suitably may be characterized as being resinous, plus another fluid composition which suitably may be characterized as a hardener. Pigments, plasticizers and other modifying ingredients may be incorporated as a part of either or both of the two main parts of the two part systems. When the two different fluid compositions are homogeneously mixed together, the resulting mass cures (that is, hardens or reacts) to form a relatively solid non-moldable mass, which may vary in character from a brittle mass to a highly elastomeric one. The curing takes place generally at room temperature, although elevated temperatures hasten it. Many two part systems which cure under ambient or room temperature conditions exhibit extraordinarily desirable properties; but they have heretofore been very messy for the user to handle. Additionally, unless special precautions are taken by the user, costly wastes of prematurely cured material or clogged bulk mixing equipment may be encountered.

Heretofore proposed devices or cartridges for two component systems have been defective for one or more reasons. They have required intermixing of the components within the cartridge or within one end of the cartridge assembly before extrusion, which then requires immediate use of the entire contents or waste of non-used material. Some have employed collapsible tubes, which give unreliable results and do not permit accurate metering extrusion, especially when different viscosity materials are packaged. All known cartridges lack separated passages through a protruding neck, and thus do not permit the preserving of a partially spent cartridge for use at a later time.

Apparatus for extrusion has heretofore lacked the combination of features required for controlled metering extrusion of coaxially packaged two part systems, and has especially lacked the combination of coaxial plungers, cartridge holding means, and plunger advancing means as taught herein.

SUMMARY OF THE INVENTION

This invention provides, as a new article of manufacture, a storable and shippable composite cartridge. The cartridge contains, in separated condition therein, at least two different fluid compositions which cure after being homogeneously mixed together. The cartridge has an elongated cylindrical main body with a round neck protruding outwardly from the head end thereof and with plunger-movable closure means at the butt end thereof. It comprises a stiff elongated cylindrical inner wall and a stiff elongated cylindrical outer wall in the structure of its main body. The inner and outer walls are coaxially oriented and spaced apart and terminate in substantially the same transverse plane at the butt end of the main body. The inner wall defines a central chamber; and the inner and outer walls define a ring chamber in the main body. One of the compositions is in the central chamber and another of the compositions is in the ring chamber. A first passageway through the protruding neck is solely in communication with the central chamber, and has a voidable seal at the outward end of it. A second passageway through the protruding neck is solely in communication with the ring chamber, and has a voidable seal at the outward end of it. An axis-slidable plunger-movable disc-like closure is within the inner wall in snug relationship therewith at the butt end of the cartridge. An axis-slidable plunger-movable donut-like closure is between the outer and inner walls in snug relationship therewith at the butt end of the cartridge. These closures permit simultaneous plunger metering extrusion of the different compositions from the cartridge at a predetermined ratio for subsequent mixing and curing. A means solely at the head end of the cartridge is for bracing the inner wall against relative movement with respect to the outer wall during plunger extrusion of the compositions. Fastening means on the neck of the cartridge is for locking a mixing nozzle thereon.

Additionally, this invention provides new apparatus to effect extrusion, and also provides the combination of the same with a cartridge such as aforenoted.

The apparatus provides for simultaneous metering extrusion of two separate compositions from the head end of a cylindrical composite cartridge having a butt end equipped with coaxial plunger-movable closures, one disc-like and the other donut-like. This apparatus comprises a frame, and a plunger assembly of coaxial elements mounted in and guided by the frame for linear advancement as a unit with respect thereto. The coaxial elements comprise a disc-faced plunger (which is carried on one end of a rod member) and a donut-faced plunger (which is carried on one end of a sleeve-like member). Holding means on the frame retains the cartridge with the disc-like and donut-like closures of the cartridge respectively axially aligned anteriorly to the disc-faced and donut-faced plungers of the plunger assembly. Advancing means provides for linear advancement of the plunger assembly with respect to the frame.

BRIEF DESCRIPTION OF THE DRAWINGS

Additional details and benefits of the invention are more fully disclosed and described by reference to the accompanying drawings, made a part hereof, wherein.

DETAILED DESCRIPTION OF THE INVENTION

Referring to FIGS. 1 to 4 inclusive, one embodiment for the elongated cylindrical cartridge will be described. A central chamber 10 contains one fluid composition; a coaxial annular ring chamber 11 contains a different fluid composition. Typically, the cartridge will be manufactured with a resinous composition in the ring chamber and a hardener for it in the central chamber; but the locations for those compositions may be reversed. The cartridge structure precludes intermixing of the different compositions within the cartridge, but permits simultaneous plunger metering extrusion of them from the cartridge at a predetermined ratio for subsequent mixing and curing.

Figure 1:
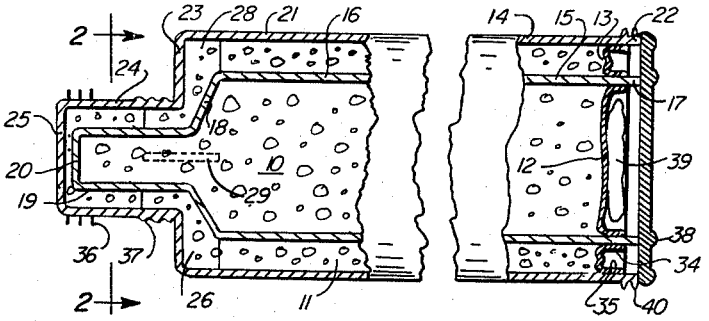
FIG. 1 is a schematic side view of a cartridge of the invention, with most parts broken away for a cross-sectional view along the longitudinal length of the cartridge.

The elongated cylindrical main body of the cartridge has a stiff elongated cylindrical inner wall 16 and a stiff elongated cylindrical outer wall 21 in its structure. These walls are coaxially oriented and spaced apart. They terminate in substantially the same transverse plane at their butt ends 17 and 22, that is, at the butt end of the cartridge. A first passageway formed by a round wall 19 extends through the protruding neck of the cartridge and communicates solely with the central chamber 10. At its outward end is a voidable seal 20, which in FIG. 1 is illustrated as a terminal cover or wall. That terminal cover 20 is easily cut off to remove it and thereby void the seal. A second passageway, consisting of the space between inner round wall 19 and an outer round wall 24, also extends through the protruding neck structure at the head end of the cartridge. This second passageway is solely in communication with the ring chamber 11. The outward end of the second passageway is covered by a voidable seal 25, illustrated as a terminal cover or wall in FIG. 1. Voiding of seal 25 is accomplished by cutting it off. Disc-like closure 12 is within and in snug relationship with inner wall 16 at (that is, proximate to) its butt end. Donut-like closure 13 is between inner 16 and outer 21 walls and in snug relationship therewith at the butt end (that is, proximate to the butt end). Both closures can be moved by plungers to slide in the axis direction of the cartridge for extrusion of the cartridge compositions. The inner and outer walls are each of uniform diameter throughout their length in the main body of the cartridge. The inner wall 16 is braced against relative movement with respect to outer wall 21 during plunger extrusion. The bracing is solely at the head end of the cartridge, as by fins 26, 27, 28 and 29. The neck 24 includes a fastening means such as threads 37 for locking a mixing nozzle on it.

In the most preferred embodiments of the cartridge, all wall parts defining limits for the inner 10 and outer 11 chambers—other than the end closures 12 and 13 and optionally also the voidable seals for the passageways of the neck—are preferably unitary as distinguished from having threaded or interlocked parts. It also is preferred that all portions or parts of the total outer wall structure 14 are in spaced relationship to corresponding sections or parts of the total inner wall structure 15; and preferably all parts are coaxial about the central cartridge axis.

Illustratively, a unitary inner wall structure has a stiff elongated hollow cylindrical main section 16 open at its butt end 17, a stiff shoulder section 18 directed radially inward at its head end, and a neck passageway section 19 protruding axially outward from its shoulder section 18. The shoulder 18 may be tapered or flat; it is preferably slightly frusto-conical. A slight taper for neck 19 is optional. All of these parts are hermetically continuous. In FIG. 1, the terminal cover 20 is also hermetically unified to the neck 19. A unitary inner wall may be made in a single molding operation by using polypropylene or high density polyethylene or other plastics material. Optionally, the main cylindrical section 16 may be made separately from the head end parts and later hermetically sealed or fused to them.

A unitary composite outer wall 14 likewise has a stiff elongated cylindrical body portion 21 open at its butt end 22, a stiff shoulder portion 23 directed radially inward at its head end, and a stiff round neck portion 24 projecting outward from its shoulder 23. The structure is hermetically continuous. As illustrated in FIG. 1, the cylindrical body 21 of the outer wall is somewhat longer than the cylindrical main section 16 of the inner wall, and is spaced outward from up to about one-third of the neck section 19 of the inner wall. Its butt end 22 is substantially aligned radially outward from the butt end 17 of the inner wall. Its shoulder portion 23 (preferably flat but optionally frusto-conical) extends toward, but is spaced from, the neck section 19 of the inner wall. Preferably, neck 24 is of smaller diameter than the cylindrical main section 16 of the inner wall and is spaced outwardly from the neck section 19 of the inner wall. The neck 24 is preferably substantially cylindrical, with a slight taper being optional and useful for easy mold removal as well as for locking or fastening some styles of mixing nozzles thereon. At the outer terminus of the neck portion 24 is a terminal cover or voidable seal 25. If desired, the terminal covers 20 and 25 may be united or integral with each other. As in the case of the inner wall structure, the basic structure of the outer wall suitability may be molded and formed out of high density polyethylene or polypropylene or nylon or other organic plastics material.

The bracing structure of circumferentially-spaced stiff fin members 26, 27, 28, 29 (see FIGS. 1 and 2) maintains the spaced wall relationship, and prevents relative shifting of the entire inner wall 15 toward the shoulder portion 23 of the outer wall 14 on application of thrust pressures against the inner wall during extrusion. The fin members are substantially aligned with the axis direction of the cartridge. They extend between the outer surface of the shoulder section 18 and the inner surface of the shoulder portion 23, particularly also in the thrust axial direction therebetween. A minimum of three fins may suffice and more than five or six are unnecessary. Bracing strength is improved as fin members occupy up to about one-third or even the entire length of the neck section 19, and extend radially out to the outer wall neck portion 24. The fin members may extend from the shoulder 18 of the inner wall as well as its neck 19 to that portion of the cylindrical body 21 of the outer wall located radially outward from the inner wall shoulder 18 and neck 19. They may be molded integrally with the inner wall (see FIG. 3), and later friction fit into (snap fit into) or even united into or with the outer wall by ultrasonic fusion or other known techniques. No bracing elements extend between the space radially outward along the length of the main cylindrical section of the inner wall to the outer wall.

The disc-like 12 and the donut-like 13 closures serve as seal structures in that they obstruct or prevent migration of the fluid compositions from their chambers of the cartridge. Both closures are preferably plunger-dilatable. They are suitably formed out of organic plastics material, such as for example, high density polypropylene or polyethylene or polystyrene or nylon.

Figure 4:
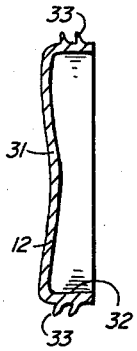
FIG. 4 is a schematic cross section through a preferred closure of the invention.

A preferred type of closure is illustrated in FIG. 4; and for purposes of description, it will be referred to as the disc-like closure 12. Its central disc portion 31 is concave as viewed from its face next to the compositional contents within the cartridge. Continuous with that concave face is a rearwardly extending ring or flange or skirt 32 having outer annular wiping or scraper or O-rings 33, which project outwardly and preferably axially anteriorly. As a disc plunger presses against the back side (or convex side) of the central concave portion 31, the concavity is relatively reduced so that the disc portion 12 assumes a relatively planar configuration. This in turn presses the ring flange part 32 outwardly, dilating it. The result is that the scraper rings 33 are pressed strongly against the inner surface of the inner wall 15 of the cartridge, thereby scraping or wiping packaged composition from that inner surface during extrusion.

The donut-like closure 13 (see FIG. 1) is suitably formed in a comparable manner. Its central or medial portion (between the inner annular flange or skirt 34 and the outer skirt 35) is annularly depressed so as to be annularly concave at its face next to packaged composition in the ring chamber. When pressed against by a donut or ring plunger, the annular cavity is dilated, that is, flattened, and forces the inner 34 and outer 35 skirts (that is, annular flanges) of the donut closure against the inner and outer surfaces defining the ring chamber of the cartridge. Scraper elements (as illustrated at 33 in FIG. 4) are on both the inner and outer skirts or flanges of the donut closure and function as above described.

Before extruding contents from the cartridge, the voidable seals of the passages of the neck must be at least substantially voided, as by cutting transversely through both necks. As a guide for the cut, an annular marking or markings 36 may be placed on the exterior of the outer neck 24. Three annular ridges 36 are illustrated. Users may desire first to cut between the outermost first and second ridges, and later cut between the second and third when any remaining part of the cartridge contents is used at a later time. Other forms of marking may be employed, such as, for example, depressions or print. An annular ridge or rib is preferred, for it also can function as an O-ring to form a seal against the interior of a mixing nozzle fixed or locked on the protruding neck.

On the exterior of the protruding neck 24, along its entire length or between any marking 36 and the shoulder 23, is a fastening means 37 for locking a mixing nozzle (see FIG. 9) upon the neck. Suitably, helical threads 37 matingly cooperative with internal threads of a mixing nozzle may be employed. Other locking means may, for example, consist of an external clamp. Alternatively, an annular groove on the neck 24 may receive a mixing nozzle fitted with a cooperatively mating inwardly directed ring or flange.

The butt end of the cartridge is suitably covered with a removable snap-on or friction held or sealed outer cover 38 to protect the inner closures 12 and 13 during shipment and storage. If cover 38 is sealed, it can be removed at use by a transverse cut across the butt end. Any suitable material, metal or plastic, may be employed for the outer cover 38. Because some compositions are extremely sensitive to moisture, a desiccant within a porous membranous bag 39 may be placed between the outer cover 38 and the inner closures 12, 13 to reduce or remove moisture from the cartridge interior. Cartridges may also be equipped with locking or fastening means 40 for attachment to specially designed plunger apparatus for metering extrusion. Such means 40 may consist essentially of helical threads (or a groove or annular ridge) on the exterior of the outer wall at its butt end (that is, proximate to its butt end). The means 40 is designed to cooperatively mate with means on the applicator apparatus to hold the cartridge for plunger extrusion.

Figure 3:
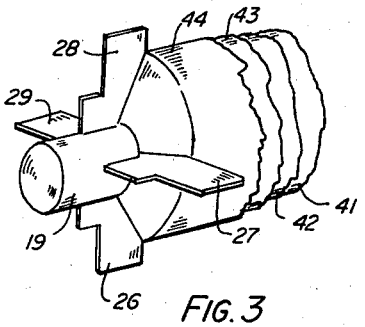
FIG. 3 is a fragmentary schematic perspective view of an inner wall structure for a cartridge of the invention, showing fin bracing members molded as a part thereof, and showing a layered laminated structure for its wall, the layers and end of the inner wall being broken away.

Depending on the fluid materials packaged in the cartridge, the wall structures of the cartridges may be modified to consist of several layers or a laminate of different materials (see FIG. 3). For example, an interior film 41 of cured elastomeric polyurethane resin, or polytetrafluoroethylene, or other resin, may be adhered upon the basic wall structure 42 of molded high density polyethylene or polypropylene or the like. A metal foil 43 may cover the entire outer surface, especially the outer surface of the inner wall structure; and to that may be adhered a film of cured polyurethane or other high density cured material 44. A foil of metal such as aluminum may be embedded within the basic wall structure of high density plastic, if desired. The foil of aluminum or other metal may be adhered on the interior surface of either or both wall structures, with or without a further layer or film of cured or high density plastics material. Metal walls may be used.

These and other layered or laminated structures, both for the internal or external walls, and for the plunger movable closures, may be employed in various combinations, as needed or desired to create imperviousness or a highly hermetic character to limit gas or vapor or moisture transmission, and thus limit deterioration of compositions within the cartridge. Even paper materials may be employed in fabricating some walls, as where the compositions are adequately protected by paper (alone or in combination with impregnation or additional layers). Preferably, the walls are crush resistant and of a highly stiff or semi-rigid character sufficient to withstand thrust forces during the extrusion step without burst or rupture. Thinner walls, which might balloon or dilate or expand during thrust extrusion, are useful in combination with applicator extrusion apparatus equipped with a sleeve or shell to restrict the ballooning on extrusion. High density plastics provide walls highly resistant to damage in shipment, and have sufficient strength or rigidity (alone or in combination with specially designed applicator apparatus), as required for proper metering extrusion.

Resin coating of walls is easily accomplished by washing thereover a solution of the particular coating composition (e.g., an elastomeric polyurethane) desired, followed by any ambient or heat cure as may be required for the composition. Metal foil layers in the walls are most preferably formed at the time of molding the walls.

Figure 5:
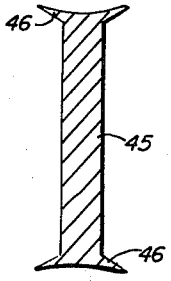
FIG. 5 is a schematic cross section through an alternative plunger-movable closure.

Varied forms of closures may be employed. The disc closure of FIG. 5 has a stiff flat central part 45, for contact by a plunger. It has a rim edge 46, suitably with an outer annular concavity, adapted to wipingly or scrapingly snugly press against the inner wall of the cartridge. The rim 46 projects as a skirt or flange from both sides of the central disc 45. Comparable features may be incorporated in a donut closure.

Figure 6:
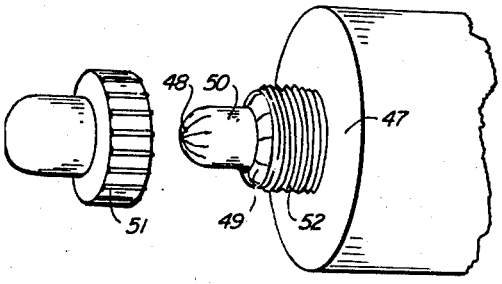
FIG. 6 is a fragmentary exploded schematic perspective view of an alternative embodiment for the head end of a cartridge.

In FIG. 6, the protruding neck at the head end 47 of a cartridge has check valve structures 48 and 49 to limit after-flow or drainage of compositions from the ends of the neck passageways during times when the plunger movement to effect extrusion is temporarily halted. These check valves suitably may consist of a plurality of valve petals or flaps extending inwardly in an annular array from an outer annulus of "hinging" or continuity (or unification) with wall material. Their adjacent inward edges are in cooperatively mating relationship. The petals or flaps are formed of relatively stiff but yieldable or bendable plastics material common with the material forming the walls of the passages through the neck. Each flap is separated from adjacent ones by lines of cut, or lines of thin or weak material easily ruptured under the pressure of plunger extrusion. The flaps dilate or open to allow exit of composition under plunger extrusion pressure, and close when such pressure is halted. In the embodiment of FIG. 6, the check valve 48 at the end of the wall structure 50 forming the passage for the central chamber projects outermost. It projects out further than the check valve 49 at the end of the passage for the ring chamber. The flaps of valve 49 encircle the central passage wall 50, and their innermost edges are either united to it by a rupturable thin web of material or abutt snugly against it. A threaded cap 51 with an internal configuration mating with the valve arrangement of the neck structure is removably threaded on neck threads 52 to protect the valve structures and press the valve flaps into a closed position. This type of voidable seal for the neck passages is especially useful where partially expended cartridges are to be stored for later use.

Figure 2:
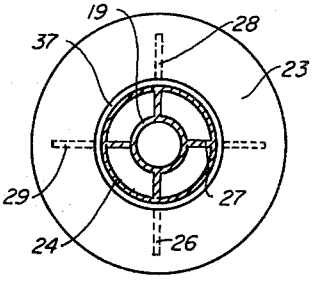
FIG. 2 is a schematic cross section taken on line 2—2 of FIG. 1.
Figure 7:
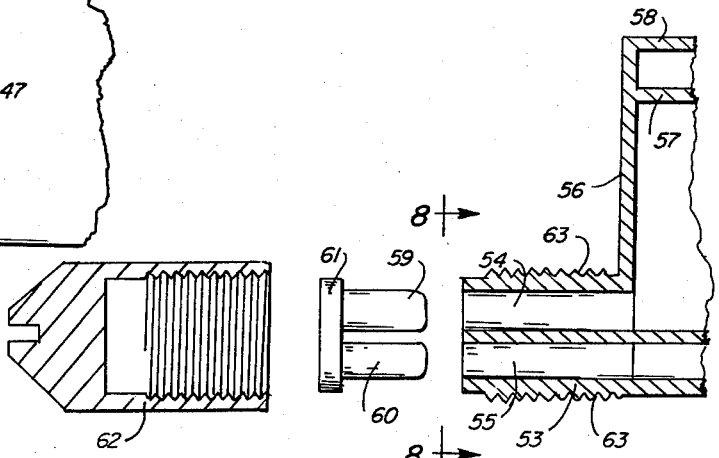
FIG. 7 is a fragmentary exploded schematic cross section of another alternative embodiment for the head end of a cartridge.
Figure 8:
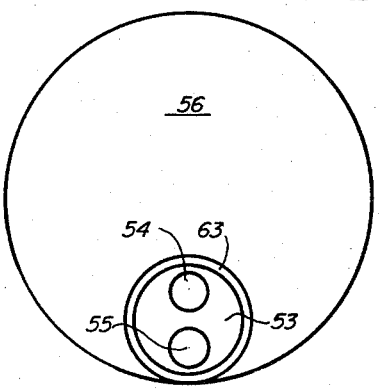
FIG. 8 is a face view of part of the embodiment of FIG. 7 taken on line 8—8 of FIG. 7.

In FIGS. 7 and 8, the neck 53 of the cartridge at least projects in an axial direction, as preferred, but is offset or laterally displaced from the cartridge axis. Further, the passageways 54 and 55 through the neck are laterally adjacent. The fin bracing of FIGS. 1, 2 and 3 is unnecessary for this head end; shoulder 56 is reinforced or thick and serves as the bracing to prevent longitudinal shift of the inner wall 57 relative to outer wall 58. The voidable seal for the passageways is formed by a removable plug assembly and cap. Plug 59 snugly closes passage 54, as does plug 60 the passage 55. Plugs 59 and 60 are united to a plate 61 so as to form a plug assembly easily pryed or removed as a unit from the passages. Threaded removable cap 62 is fastened to the neck over neck threads 63, and contributes to maintaining the voidable seal of the plug assembly.

A wide variety of two part systems may be employed as the fluid compositions in the cartridge. The two parts are conveniently referred to as a "Part A" composition and a "Part B" composition. Illustratively, an epoxy (e.g., an epichlorohydrin/bisphenol A type) may be the basic component for Part A; and a hardener or catalyst (e.g., a modified polyamide, dihydrazide, etc.) for curing of the epoxy may be the basic component for Part B. An amide or amine or urethane or other diisocyanate-reactive material may be employed as one part, with a diisocyanate as the other. A butyl, such as a low molecular weight butyl rubber or rubber precursor may be in one part, with a curing agent such as p-quinone dioxime in the other. Two part systems including polysulfides and silicones are also known. Foamable two part systems are known. These, as well as a variety of others, now available or hereafter developed, may be employed. Fillers, pigments, plasticizers and other ingredients may be included as desired. Highly reactive or moisture reactive materials, such as, for example, diisocyanates, can be employed in the cartridge and shipped and stored for reasonable times, provided approximately impervious walls are used.

Filling of the cartridge chambers so as to avoid inclusion of undesired environmental gases or moisture may be accomplished using known technology. Illustratively, while filling and affixing the closures may obviously be accomplished under vacuum conditions, that expense may be voided in most cases, even where moisture vapor inclusion is undesired, by filling in a relatively low humidity ambient environment and affixing the closure to the cartridge chamber with a removable reed of plastic (e.g., polytetrafluoroethylene) extending within the chamber along a chamber wall. Ambient gases can be excluded from the filled chamber by pressing the closure against the filled composition to cause their escape along the reed, after which the reed is withdrawn.

Figure 9:
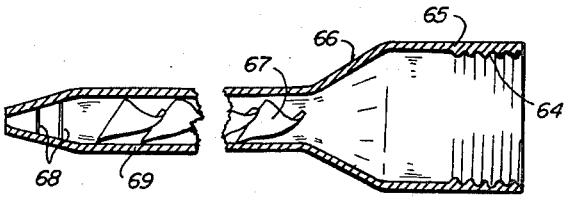
FIG. 9 is a schematic cross-sectional view of one type of useful mixing nozzle.

The mixing nozzle of FIG. 9 is but one useful type and includes mixing structure of the motionless or nondynamic type and capable of achieving mixing solely due to the pressure of extrusion of the two fluid compositions without any relative movement of the structure. Details of its internal construction are set forth in U.S. Pat. No. 3,286,992, issued Nov. 22, 1966. The nozzle has a special annular coupling or part 65 with internal fastening means 64 (such as a helical threading) for mating relationship with the fastening or locking means (e.g. threads 37) of the neck of the cartridge. It is attached to the neck after voiding the neck seals, or after at least removing (that is, voiding) any protective end cap so that the only remaining step for complete voiding may be that of rupturing a weak web of seal. The nozzle is tapered between its coupling 65 and its mixing chamber 69. Within chamber 69 are a series of mixing elements 67, such as curved triangular shapes. Screens 68 serve as the final blenders before exit of composition to a work piece or surface.

Controlled metering extrusion of the two separate compositions from the head end of the cylindrical composite cartridge in proper ratio for homogeneous blending in the mixer is accomplished with apparatus which removably holds the cartridge in proper relationship to coaxial plungers of the extrusion apparatus and which guides those plungers in their movement.

Figure 11:
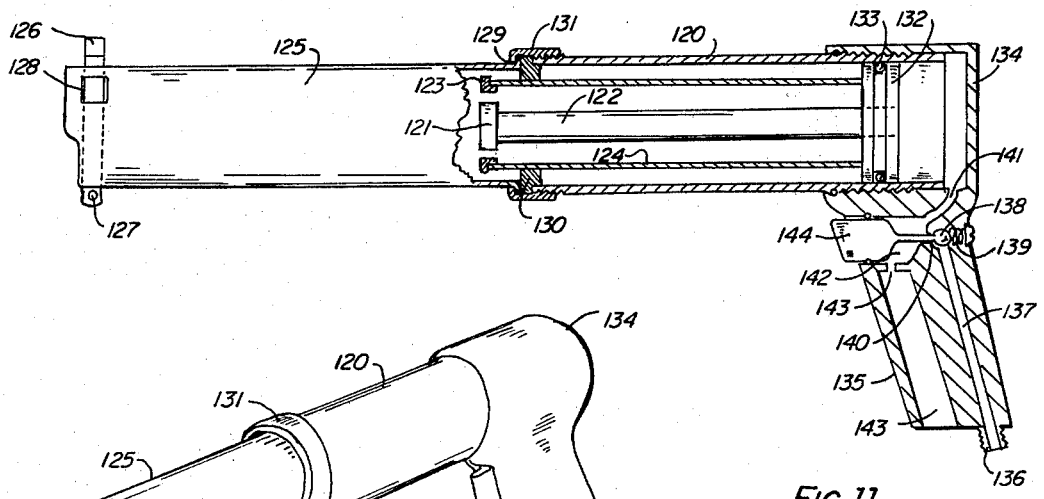
FIG. 11 is a sectional view along the longitudinal axis of the apparatus of FIG. 10, with some parts in side elevation.
Figure 10:
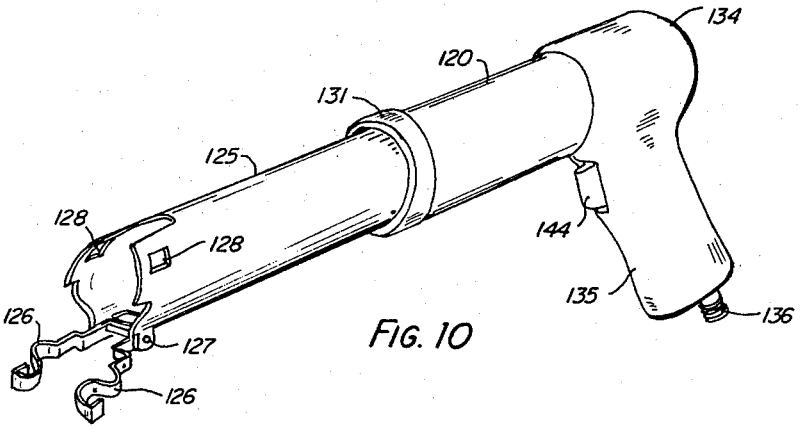
FIG. 10 is a schematic perspective view of a pneumatic powered applicator apparatus.

The most preferred apparatus for extrusion is that of FIGS. 10 and 11. It has a basic frame 120 within which a plunger assembly of coaxial elements are mounted and guided for linear advancement as a unit. The coaxial elements comprise a disc-faced plunger 121 carried on one end of a central axis rod member 122, and a donut-faced plunger 123 carried on one end of a sleeve-like member 124. Both plungers are mounted so as to lie in the same transverse plane; and the strength imparted by the sleeve carrier 124 contributes to stabilization of the donut plunger against wobbling out of the plane. The plungers are broad-faced which provides for a large area of contact with the disc and donut closures of the cartridge and therefore enhances reliability of metering extrusion.

The cartridge is held on the frame by a cradle or sleeve holder 125. A rigid metal sleeve holder having a diameter just sufficiently large to receive the cartridge without binding is most preferred. Such sleeves restrict expansion of the outer cartridge wall during extrusion and permit the use of relatively thinner outer cartridge walls. The cartridge is held in holder 125 by snapping retaining clamps 126 mounted on pin 127 into notches or openings 128. The holder 125 is rigidly fixed to the basic frame 120 by using threaded lock nut 131 to tightly draw annular flange 129 on the inner end of the holder 125 against guide annulus 130 of the frame 120. The arrangement places the disc and donut closures of the cartridge in axial alignment in front of the disc-faced 121 and donut-faced 123 plungers, respectively. The alignment is maintained throughout the path of plunger movement.

A piston 132 having an O-ring seal 133 serves as the base mounting point for the rod 122 and sleeve 124, and is part of the total plunger assembly. Cylindrical base frame 120 guides piston 132 in its linear movement therein. Sleeve 124 is also guided in its linear movement, as by annulus 130 of the base frame 120.

Advancement of piston 132, and consequently the entire plunger assembly, is accomplished hydraulically. A frame housing 134 is mounted on the rear of cylindrical frame 120 and sealed suitably by an O-ring. A pistol grip 135 extends from the housing 134. A coupling 136 is for attachment of a source of hydraulic fluid such as pressurized air. The air enters through conduit 137, to valve ball 138 biased by spring 139 against valve seat 140. As so biased, the introduction of air into housing 134 through conduit 141 is prevented; and also, air within housing 134 is allowed to pass through conduit 141, chamber 142, and out exit passage 143. Control member 144, in the nature of a trigger, is appropriately hydraulically sealed for linear movement in chamber 142. When pressed, control member 144 closes the exit passage 143 and opens valve 138 to allow air entrance through conduit 137, chamber 142. and conduit 141 into housing 134 to move piston 132. Upon release of pressure on control member 144, bias spring 139 moves it to its original position, as well as valve 138 to its seat 140. Residual travel of piston 132 after release of control trigger 144 is prevented by the bleeding of air out of housing 134 through conduit 141, chamber 142, and exit 143. This apparatus permits precise controlled incremental forward movement of piston 132 for extrusion of composition.

Figure 12:
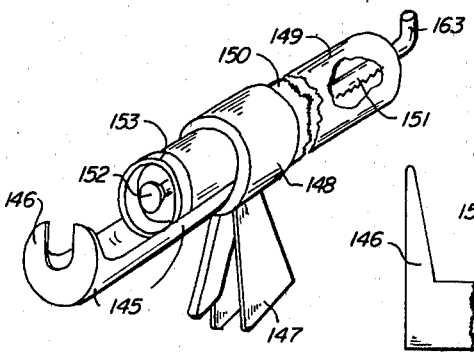
FIG. 12 is a schematic perspective view of an alternative applicator apparatus.
Figure 13:
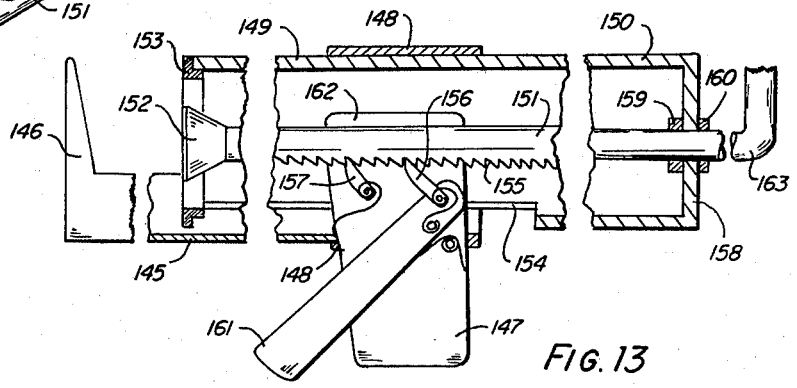
FIG. 13 is a sectional view along the longitudinal axis of the apparatus of FIG. 12.

In FIGS. 12 and 13, the illustrated gun apparatus has a semi-cylindrical cradle 145 for holding a cartridge with its butt end axially aligned with the plunger face members. The curvature of the cradle is slightly larger than the outer diameter of the cartridge. The cartridge shoulder 23 abutts against a forward or anterior slotted cap 146, through which the neck 24 projects. A handle or pistol grip 147 is fixedly attached to the rear part of the frame of the cradle. A frame ring member 148 extends upwardly from its point of fixed attachment to the handle 147.

A plunger assembly 149 is mounted within the ring member 148 and is guided in its linear movement thereby. The coaxial elements of the plunger assembly are its carrier members 150, 151 and plunger face members 152, 153. The sleeve-like carrier member 150 has an elongated slot opening 154 on its lower side through which frame elements extend from the pistal grip 147 into its interior. The rod carrier member 151 is coaxially within the sleeve 150. Teeth or notches 155 on the lower side of rod 151 serve as incremental structural means matingly cooperative with pawl members 156, 157 for incremental advancement of the plunger assembly. The carrier members 150, 151 are coupled together at a radial joint formed by a rear inward shoulder 158 on the sleeve 150 mounted between collars 159, 160 rigidly fixed to the rear end of rod 151. This coupling permits rotational movement of the rod 151 with respect to the sleeve 150, but unites the two carrier members for linear advancement as a unit. A disc-faced plunger 152 is mounted (that is, carried) on the anterior end of the rod 151; and a donut-faced plunger 153 is carried on the anterior end of the sleeve 150.

The ratchet type advancing means includes a trigger operated pawl 156, biased under spring tension against the rod 151, and therefore against the teeth of that rod. When the trigger 161 is pulled toward the piston grip 147, pawl 156 locks into a notch or tooth of rod 151 and moves or advances the entire plunger assembly an incremental step forward. A stationary pawl 157, biased by a spring toward the rod 151, holds the rod 151 against retractive or backward movement when the trigger 161 is released. The trigger 161 is spring biased to move away from the piston grip, and in doing so moves the pawl 156 rearwardly in readiness for another incremental advancement of the plunger assembly. Frame elements through the slot 154 of the sleeve 150 extend as a brace or collar 162 about rod 151 and function as a guide for the movement of rod 151. The master frame ring element 148, as well as the frame elements from the pistol grip through slot 154, function as guides for the linear movement of sleeve 150. Retraction of the plunger assembly from fully advanced condition is accomplished by turning rod 151 a quarter revolution using handle 163, and then withdrawing it rearwardly. Because ratchet advancing allows for some backward movement of the plunger assembly between advancing steps, it is less useful than the other forms of advancing illustrated.

Figure 14:
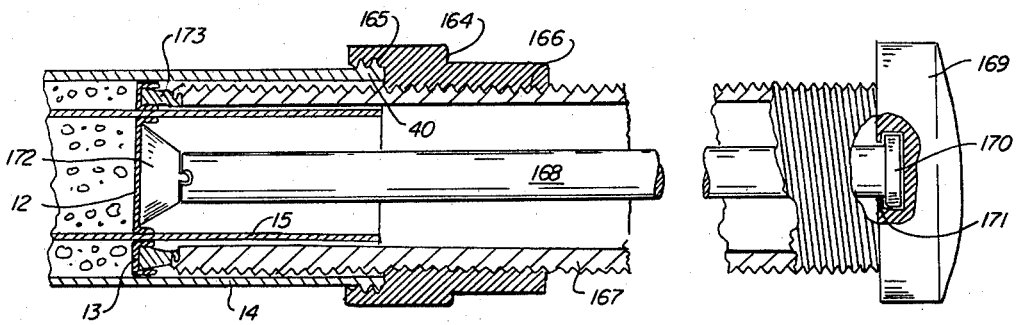
FIG. 14 is a schematic side view, mostly broken away and in cross section, of a further applicator apparatus, and includes a cross section of the butt end of a cartridge mounted therein and undergoing extrusion.

In FIG. 14, the frame of suitable apparatus is illustrated as consisting essentially of a socket ring 164. It has an internal fastening or holding means 165 within it for retaining a cartridge on it by butt end threads 40 of the cartridge. The ring 164 also has an internally threaded annulus 166 of lesser internal diameter than fastening or holding means 165 and located rearwardly of the same. The sleeve-like carrier member 167 is equipped with external helical threads mating with the internal helical threads of the annulus 166. The rod carrier member 168 is mounted to the handle portion 169 of the sleeve member 167, suitably by a coupling permitting rotational movement of sleeve 167 with respect to rod 168. For example, a flange 170 on rod 168 may be snapped into a recess behind yieldable lips 171 molded in the handle 169. A disc-faced plunger 172 and a donut-faced plunger 173 are mounted respectively on the opposite end of the rod 168 and sleeve 167. Each plunger may be coupled or mounted so as not to follow rotary movement for its carrier member 167, 168. Cooperatively mating annular grooves or recesses or sockets in the coupling structure permit such a result. Preferably, the extrusion gun of FIG. 14 is made entirely of relatively stiff or rigid plastic material. To be noted is the illustrated plunger-dilation or flattening of the closures 12 and 13 on plunger extrusion of the cartridge contents.

The most preferred applicator extrusion apparatus is equipped with advancing means moved by motive power not exclusively manual. Thus, hydraulically powered advancing means (for example, pneumatic or liquid fluid), or electrically powered advancing means, are most preferred. The apparatus may be computer programmed for automatic operation.

Included among the benefits of the invention are the following. The ratio between the different compositions packaged is conveniently regulated by the relative sizes chosen for the chambers of the cartridge. A standardized external size for the cartridge, for example, a size comparable to calking tubes of current use, or any larger or smaller size, may be adopted; and the relative ratio or volume of the different compositions in the cartridge may be adjusted as desired by employing different diameters for the inner wall 16. The contents of the different chambers of the cartridge are extrudable with positive metering effect to maintain the proper ratio therebetween for subsequent homogeneous blending and curing. This results from the coaxial arrangement, which overcomes the problem of lag or disproportionate extrusion commonly encountered when laterally spaced or collapsible chambers are employed. The separate passageways through the neck (which neck has a blunt end) prevent intermixing of the compositions therein, and permit later extrusion of the contents of a partially spent cartridge. Additionally, the separate passageways in the neck contribute to some extension of the workable pot life of mixed compositions after extrusion, thereby permitting more practical working time for the user before hardening. The exotherm of heat from the work of mixing in the mixing nozzle is relatively low since the time for passage through the mixing nozzle is brief, such as a matter of seconds or a fractional period. Thus, two part compositions having an extremely short pot life, even less than a minute, can for the first time be easily handled and applied to a work surface with great convenience as a result of this invention.

That which is claimed is:

1. An apparatus for the storage, shipping, metering, mixing and dispensing of at least two different fluid compositions which cure when mixed together, said apparatus comprising:

an elongated cylindrical main body including an elongated cylindrical outer wall member and an elongated cylindrical inner wall member positioned coaxially within and spaced radially inwardly of said outer wall member;

said inner wall member defining an elongated central chamber containing therein a first fluid composition;

said outer wall member and said inner wall member defining therebetween an elongated annular chamber containing therein a second fluid composition different from said first fluid composition;

said main body having at a forward first end thereof a shoulder integral with said outer and inner wall members, said shoulder closing adjacent forward ends of said central chamber and said annular chamber, said shoulder having an inner wall extending substantially transverse to the longitudinal axis of said main body;

a cylindrical neck integral with said shoulder and extending forwardly therefrom at a position radially offset from said longitudinal axis of said main body, said neck having a forward end defined by a plane extending substantially transverse to said longitudinal axis;

a first passageway extending through said shoulder and said neck, said first passageway having a rear end in communication solely with said central chamber and a forward end opening onto said transverse plane, said rear end of said first passageway comprising a circular hole opening in said transverse inner wall of said shoulder;

a second passageway extending through said shoulder and said neck, said second passageway having a rear end in communication solely with said annular chamber and a forward end opening onto said transverse plane, said rear end of said second passageway comprising a circular hole opening in said transverse inner wall of said shoulder;

said neck including an integral solid wall separating said first and second passageways throughout the entire length of said neck, said solid wall having a rear end separating said rear ends of said first and second passageways and a forward end terminating substantially at said transverse plane;

a disc-shaped closure member positioned within a rear end of said central chamber, said disc-shaped closure member having on the outer periphery thereof means forming a sliding seal with the inner surface of said inner wall member;

an annular closure member positioned within a rear end of said annular chamber, said annular closure member having on the inner and outer peripheries thereof means forming respective sliding seals with the outer surface of said inner wall member and the inner surface of said outer wall member;

said disc-shaped closure member and said annular closure member being capable of simultaneous axial sliding movement respectively through said central chamber and said annular chamber thereby to achieve metered extrusion of said first and second fluid compositions through said first and second passageways;

said disc-shaped closure member and said annular closure member being free of any direct attachment or connection to any structure capable of imparting axial sliding movement thereto;

said disc-shaped closure member and said annular closure member each having a concave configuration with the respective concavities thereof facing forwardly, such that upon extrusion force being applied thereto said disc-shaped closure member expands radially outwardly against said inner surface of said inner wall member and said annular closure member expands radially outwardly and inwardly respectively against said inner surface of said outer wall member and said outer surface of said inner wall member;

said sliding seal forming means on said outer periphery of said disc-shaped closure member and on said outer and inner peripheries of said annular closure member comprising rearwardly extending annular skirts having on the respective peripheries thereof flexible annular scrapper elements adapted to be pressed against the respective said wall member surfaces upon said radial expansion, said scrapper elements being inclined to extend forwardly from said skirts in the absence of said radial expansion; and mixing and dispensing nozzle means, removably connected to the outer surface of said neck, for receiving said first and second fluid compositions extruded through said first and second passageways, for mixing said first and second fluid compositions to form a mixed composition, and for dispensing said mixed composition, said mixing and dispensing nozzle means having fixed structure capable of achieving said mixing solely due to the pressure of extrusion of said first and second fluid compositions and without any relative movement of said structure.

2. An apparatus for the storage, shipping, metering, mixing and dispensing of at least two different fluid compositions which cure when mixed together, said apparatus comprising:

an elongated cylindrical main body including an elongated cylindrical outer wall member and an elongated cylindrical inner wall member positioned coaxially within and spaced radially inwardly of said outer wall member;

said inner wall member defining an elongated central chamber containing therein a first fluid composition;

said outer wall member and said inner wall member defining therebetween an elongated annular chamber containing therein a second fluid composition different from said first fluid composition;

said main body having at a forward first end thereof a shoulder integral with said outer and inner wall members, said shoulder closing adjacent forward ends of said central chamber and said annular chamber, said shoulder having an inner wall extending substantially transverse to the longitudinal axis of said main body;

a cylindrical neck integral with said shoulder and extending forwardly therefrom at a position radially offset from said longitudinal axis of said main body, said neck having a forward end defined by a plane extending substantially transverse to said longitudinal axis;

a first passageway extending through said shoulder and said neck, said first passageway having a rear end in communication solely with said central chamber and a forward end opening onto said transverse plane, said rear end of said first passageway comprising a circular hole opening in said transverse inner wall of said shoulder;

a second passageway extending through said shoulder and said neck, said second passageway having a rear end in communication solely with said annular chamber and a forward end opening onto said transverse plane, said rear end of said second passageway comprising a circular hole opening in said transverse inner wall of said shoulder;

said neck including an integral solid wall separating said first and second passageways throughout the entire length of said neck, said solid wall having a rear end separating said rear ends of said first and second passageways and a forward end terminating substantially at said transverse plane;

a disc-shaped closure member positioned within a rear end of said central chamber, said disc-shaped closure member having on the outer periphery thereof means forming a sliding seal with the inner surface of said inner wall member;

an annular closure member positioned within a rear end of said annular chamber, said annular closure member having on the inner and outer peripheries thereof means forming respective sliding seals with the outer surface of said inner wall member and the inner surface of said outer wall member;

said disc-shaped closure member and said annular closure member being capable of simultaneous axial sliding movement respectively through said central chamber and said annular chamber thereby to achieve metered extrusion of said first and second fluid compositions through said first and second passageways;

said disc-shaped closure member and said annular closure member being free of any direct attachment or connection to any structure capable of imparting axial sliding movement thereto;

said disc-shaped closure member and said annular closure member each having a stiff flat central portion, with peripheral edges of said central portions having therein annular recesses, and annular rims extending forwardly and rearwardly from each said recess; and mixing and dispensing nozzle means, removably connected to the outer surface of said neck, for receiving said first and second fluid compositions extruded through said first and second passageways, for mixing said first and second fluid compositions to form a mixed composition, and for dispensing said mixed composition, said mixing and dispensing nozzle means having fixed structure capable of achieving said mixing solely due to the pressure of extrusion of said first and second fluid compositions and without any relative movement of said structure.

3. An apparatus as claimed in claims 1 or 2, wherein said cylindrical neck has external threads, and said nozzle means includes internal threads for removably connecting said nozzle means to said neck.

4. An apparatus as claimed in claims 1 or 2, further comprising plug means for sealing said forward ends of said first and second passageways upon removal of said nozzle means from said neck, said plug means comprising a plate having extending therefrom a pair of plugs dimensioned to fit tightly into said forward ends of said passageways, said plugs being spaced by a distance sufficient to enable said wall of said neck to extend between said plugs when said plugs are fitted into said passageways.

5. An apparatus as claimed in claim 4, further comprising a cap dimensioned to fit over said plug means and said neck to retain said plug means in sealing position.

6. An apparatus as claimed in claims 1 or 2, wherein said inner and outer wall members are formed of an organic plastic material.

7. An apparatus as claimed in claims 1 or 2, wherein one of said fluid compositions comprises an epoxy resin.

8. An apparatus as claimed in claims 1 or 2, wherein one of said fluid compositions comprises a polyurethane resin.

9. An apparatus as claimed in claims 1 or 2, further comprising a protective cover removably connected to a rear end of said main body for sealing said rear ends of said chambers.

10. An apparatus as claimed in claims 1 or 2, further comprising means at the outer rear end of said outer wall member for connecting said main body to an extruding apparatus.

* * * * *